US009673555B2

(12) United States Patent
Wang et al.

(10) Patent No.: US 9,673,555 B2
(45) Date of Patent: Jun. 6, 2017

(54) CONNECTOR PLUG AND CONNECTOR ASSEMBLY

(71) Applicant: Tyco Electronics (Shanghai) Co. Ltd., Shanghai (CN)

(72) Inventors: Zhengxi Wang, Shanghai (CN); Jianfeng Wu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/931,405

(22) Filed: Nov. 3, 2015

(65) Prior Publication Data

US 2016/0056566 A1 Feb. 25, 2016

Related U.S. Application Data

(63) Continuation of application No. PCT/IB2014/061002, filed on Apr. 25, 2014.

(30) Foreign Application Priority Data

May 3, 2013 (CN) ..... 2013 2 0236008 U

(51) Int. Cl.

| | |
|---|---|
| ***H01R 13/631*** | (2006.01) |
| ***H01R 13/502*** | (2006.01) |
| ***H01R 13/64*** | (2006.01) |
| *H01R 13/627* | (2006.01) |
| *H01R 12/72* | (2011.01) |

(52) U.S. Cl.

CPC ..... *H01R 13/502* (2013.01); *H01R 13/64* (2013.01); *H01R 12/725* (2013.01); *H01R 13/6272* (2013.01)

(58) Field of Classification Search

CPC ..... H01R 13/631; H01R 13/629
USPC ..... 439/374, 376
See application file for complete search history.

(56) References Cited

U.S. PATENT DOCUMENTS 4,900,261 A * 2/1990 Gentry ..... H01R 13/6273 439/353
4,941,840 A * 7/1990 Okada ..... H05K 7/1401 439/376
4,960,387 A * 10/1990 Davis ..... H01R 13/629 439/374
5,104,331 A * 4/1992 Goble ..... H01R 35/04 439/341
5,131,867 A * 7/1992 Peloza ..... H01R 13/743 439/374
5,161,996 A * 11/1992 Locati ..... H01R 12/7011 439/374

(Continued)

FOREIGN PATENT DOCUMENTS

EP 0493107 A2 1/1992
EP 1453150 A1 1/2004

(Continued)

OTHER PUBLICATIONS

PCT International Search Report, International Application No. PCT/IB2014/061002, dated Jul. 14, 2014, 5 pages.

*Primary Examiner* — Gary Paumen
(74) *Attorney, Agent, or Firm* — Barley Snyder

(57) ABSTRACT

A connector plug is disclosed. The connector plug has a housing and a plurality of end walls disposed on the housing. The plurality of end walls each include at least one block notch.

23 Claims, 7 Drawing Sheets

(56) References Cited

U.S. PATENT DOCUMENTS 5,302,136 A * 4/1994 St. Germain ..... H01R 13/631 439/341
5,330,362 A 7/1994 Ito et al.
5,359,489 A * 10/1994 Hass ..... H05K 7/16 361/732
5,378,169 A * 1/1995 Volz ..... H01R 23/6873 439/376
5,458,497 A * 10/1995 Yasumura ..... H01R 12/721 439/341
5,651,697 A * 7/1997 Cinquegrani ..... H01R 13/6272 439/374
5,713,754 A * 2/1998 Samejima ..... H01R 13/6315 439/374
5,865,651 A * 2/1999 Dague ..... H01R 29/00 439/218
6,093,042 A * 7/2000 Lemke ..... H05K 7/1061 439/341
6,155,860 A * 12/2000 Lemke ..... H01R 13/112 439/341
6,244,888 B1 * 6/2001 Cappe ..... H01R 13/193 439/341
6,350,141 B1 * 2/2002 Houtz ..... H01R 13/193 439/341
7,367,812 B2 * 5/2008 Shih ..... H01R 13/6275 439/374
2004/0161961 A1 * 8/2004 Endo ..... H01R 13/631 439/374
2008/0166909 A1 * 7/2008 Kubota ..... H01R 13/631 439/376
2011/0021063 A1 * 1/2011 Tsai ..... H01R 13/506 439/374
2011/0039441 A1 * 2/2011 Zhu ..... H01R 12/57 439/374
2011/0237115 A1 * 9/2011 Cao ..... G06F 1/185 439/374
2012/0270431 A1 * 10/2012 Foltz ..... H01R 13/514 439/374
2013/0210265 A1 * 8/2013 Davis ..... H01R 13/629 439/374
2013/0273768 A1 * 10/2013 Peng ..... H01R 12/83 439/374

FOREIGN PATENT DOCUMENTS

GB 2373646 A 9/2002
GB 2378827 A 2/2003

* cited by examiner

CONNECTOR PLUG AND CONNECTOR ASSEMBLY

CROSS-REFERENCE TO RELATED APPLICATIONS

This application is a continuation of International Application No. PCT/IB2014/061002, filed Apr. 25, 2014, which claims the benefit of Chinese Patent Application No. CN201320236008.9 filed on May 3, 2013 in the State Intellectual Property Office of China, the whole disclosure of which is incorporated herein by reference.

FIELD OF THE INVENTION

The present invention relates to a connector plug and connector assembly, and more particularly to a connector plug having plug contacts and a connector receptacle having receptacle contacts.

BACKGROUND

In the prior art, a connector assembly generally comprises a connector plug and a connector receptacle mated with the connector plug. A plurality of receptacle contacts are provided in the receptacle, and a plurality of plug contacts are provided in the plug. When the plug is inserted into the receptacle in a predetermined correct posture, the plug contacts electrically connect to the receptacle contacts. However, if the plug is inserted into the receptacle in an incorrect posture, as shown in FIG. 1, it may cause a disadvantageous condition where a bottom edge of the plug presses and damages the receptacle contacts in the receptacle.

SUMMARY

An object of the present invention is to provide a connector plug that can prevent a bottom of the plug from pressing and damaging receptacle contacts of a receptacle due to insertion misalignment. The disclosed connector plug has a housing and a plurality of end walls disposed on the housing. The plurality of end walls each include at least one block notch.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
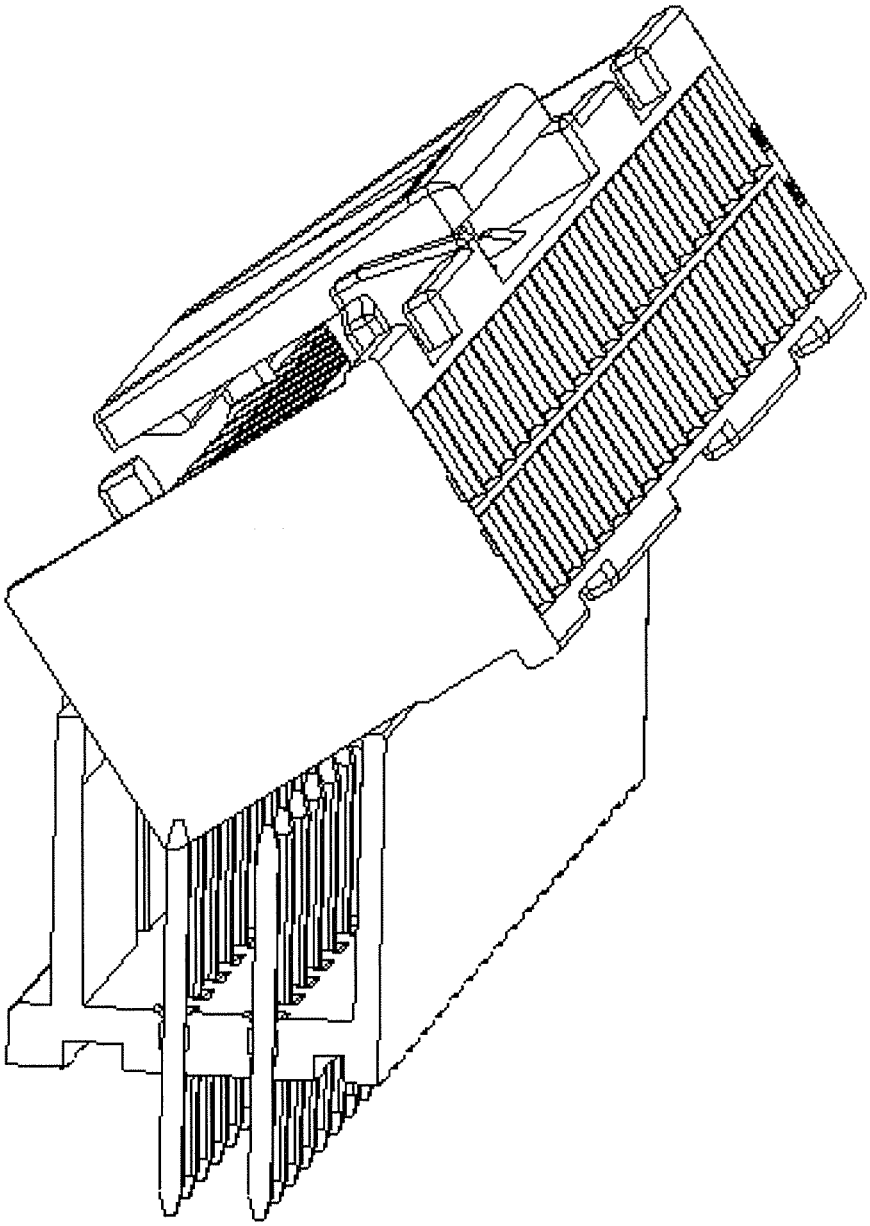
Fig.1 (PRIOR ART)
FIG. 1 is a perspective view of a prior art plug inserted into a receptacle.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 4:
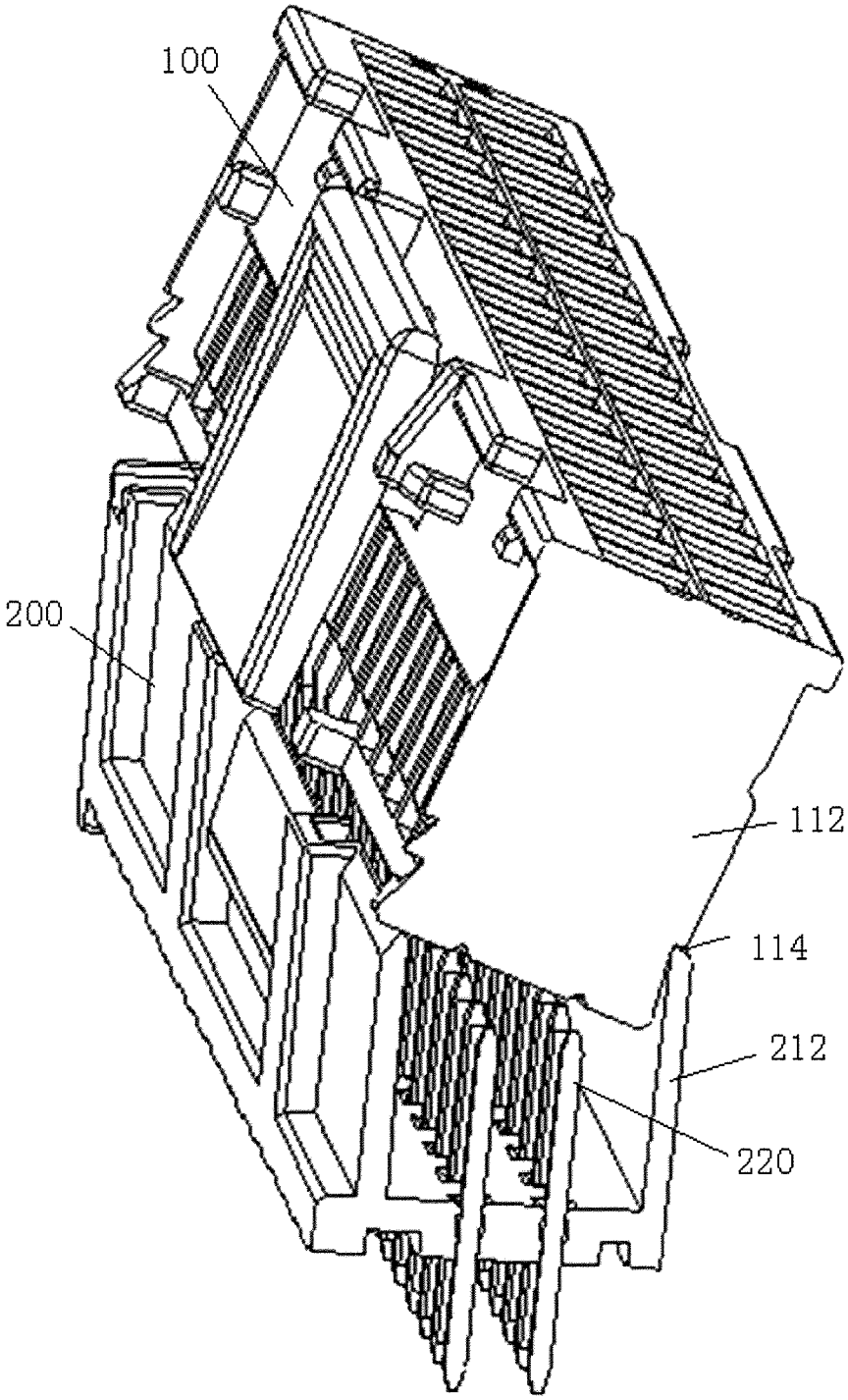
FIG. 4 is a perspective view of the plug of FIG. 2 inserted into the receptacle of FIG. 3 in a first orientation.

The connector assembly, as shown in FIG. 4, includes a connector plug 100 and a connector receptacle 200. The major components of the invention will now be described in greater detail.

Figure 2:
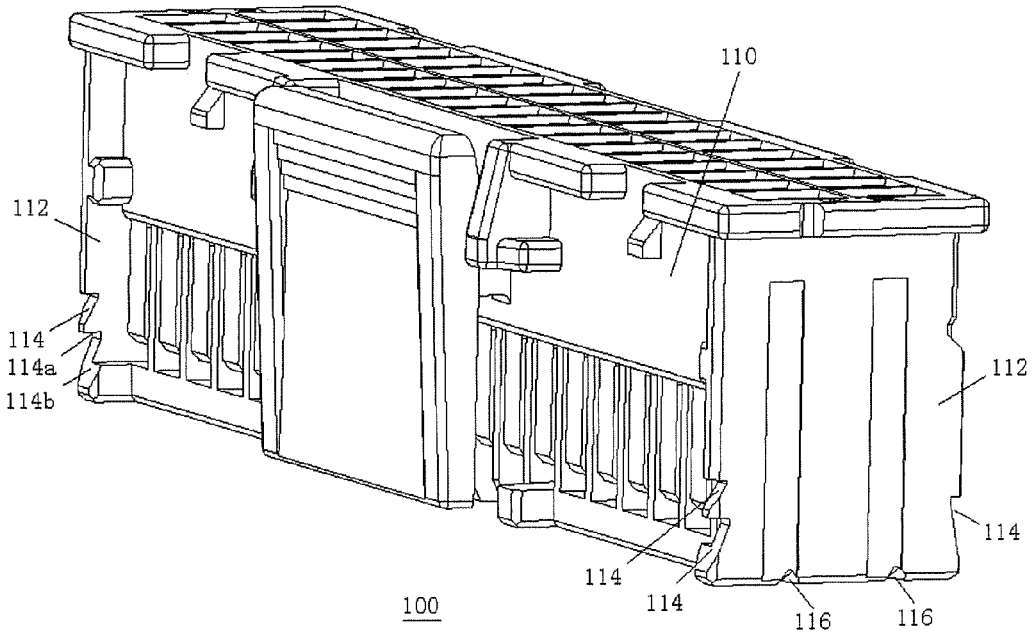
FIG. 2 is a perspective view of a plug according to the present invention.

As shown in FIG. 2, the connector plug 100 includes a plug housing 110, two end walls 112, a plurality of block notches 114, a plurality of indentations 116, and a plurality of plug contacts (not shown).

The plurality of plug contacts (not shown) are disposed in the housing 110.

The two end walls 112 are provided at opposite end portions of the housing 110 in a length direction of the housing 110, and are both formed in a width direction of the housing 110 such that they extend orthogonal to the length direction of the housing 110. In an exemplary embodiment of the present invention, one side of each the two end walls 112 extends beyond the housing 110 in a width direction of the housing 110. The side of each end wall 112 that extends beyond the housing 110 extends beyond the same side of the housing 110. In another exemplary embodiment, shown in FIG. 2, both sides of each of the two end walls 112 extend beyond the housing 110 in the width direction of the housing 110.

In the exemplary embodiment of FIG. 2, both sides of each of the two end walls 112 are formed with the block notches 114 at a location adjacent to a bottom of the connector plug 100. As shown in FIGS. 4-7, the bottom of the connector plug 100 is a mating end of the connector plug 100. The present invention is not limited to this, for example, in another exemplary embodiment, only one side of the each of the two end walls 112 in the width direction of the plug housing 110 is formed with the block notch 114, and the side of the end wall 112 without the block notch does not extend beyond the housing.

Figure 5:
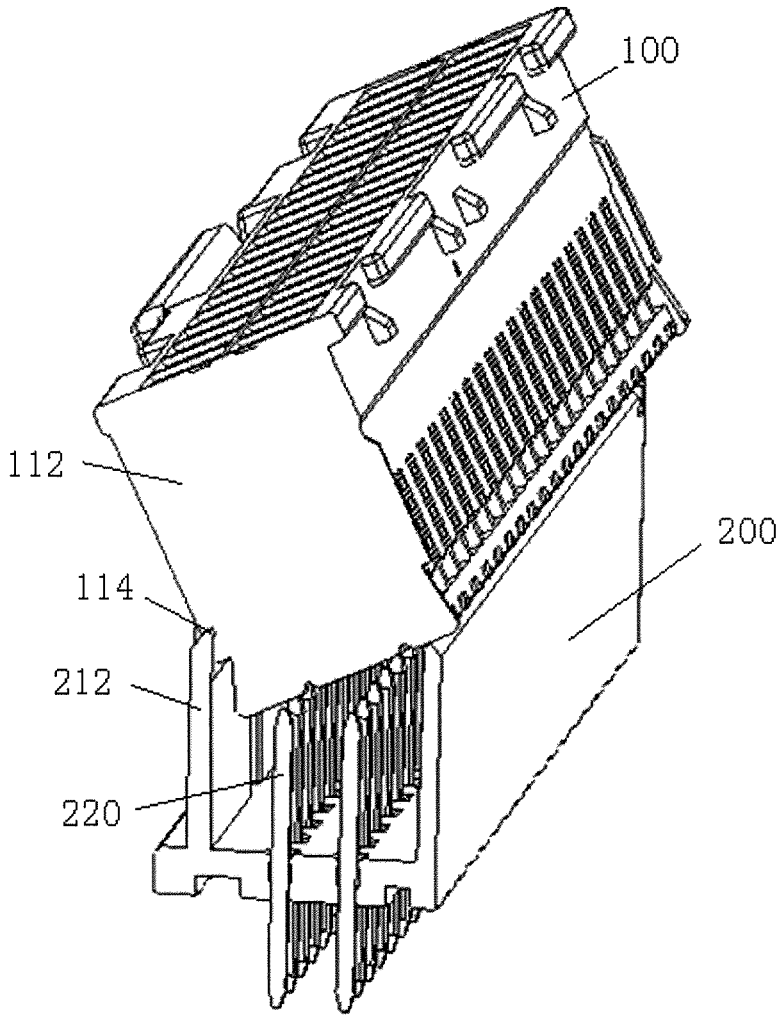
FIG. 5 is a perspective view of the plug of FIG. 2 inserted into the receptacle of FIG. 3 in a second orientation.
Figure 6:
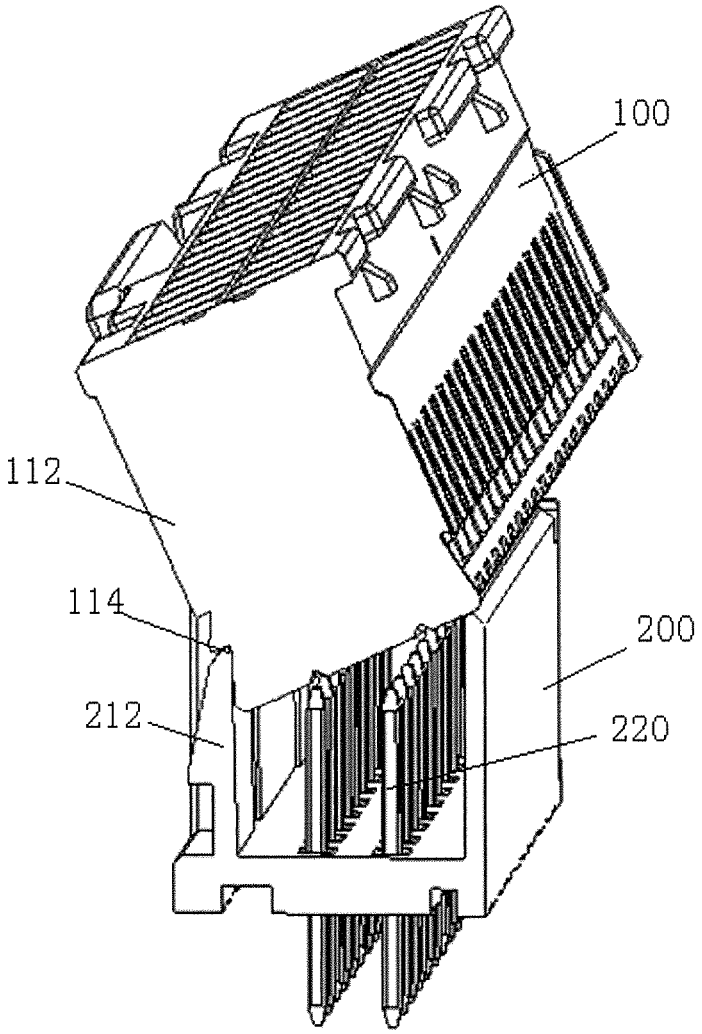
FIG. 6 is a perspective view of the plug of FIG. 2 inserted into the receptacle of FIG. 3 in a third orientation.

The block notch 114 may be configured to have various shapes as long as the block notch 114 can be engaged or fitted with an upper edge of a side wall of a receptacle when the plug 100 slides on the upper edge of the side wall of the receptacle as shown in FIGS. 4-6. For example, the block notch may be configured to have an arc groove shape.

In an exemplary embodiment, the block notch 114 comprises a block face 114*a* extending away from the housing 110 substantially in the width direction of the housing 110. The block face 114*a* may be formed by a bump protruding from one side of the end wall 112 in the width direction, and a bottom surface of the bump defines the block face 114*a*. The block notch 114 may be defined between the block face 114*a* and the one side of the end wall 112 in the width direction.

In an exemplary embodiment, as shown in FIG. 2, the block notch 114 may further comprises a guide face 114*b* extending aslant and away from a bottom surface of the end wall 112. The block face 114*a* and the guide face 114*b* together define the block notch.

In another exemplary embodiment, as shown in FIG. 2, one side of each of the end walls 112 is provided with one block notch 114, and the other side of each of the end walls 112 is provided with two block notches 114 arranged in a height direction of the housing 110 and separated from each other. On such an end wall 112, the block face 114*a* of an upper one of the two block notches 114 and the block face 114*a* of the single block notch 114 at the other side are located at the same height. In an alternative embodiment, the right side of the end wall 112 of FIG. 2 may be formed with two block notches as the left side thereof. In another exemplary embodiment, the guide face 114*b* of a lower one of the two block notches 114 and the guide face 114*b* of the single block notch 114 at the other side each extend from the bottom side of the end wall 112 toward the respective block face 114*a*.

As shown in FIG. 2, at least one indentation 116 is formed in the bottom side of each end wall 112.

In another embodiment, the plug 100 may be a plurality of shorter plugs 100.

Figure 3:
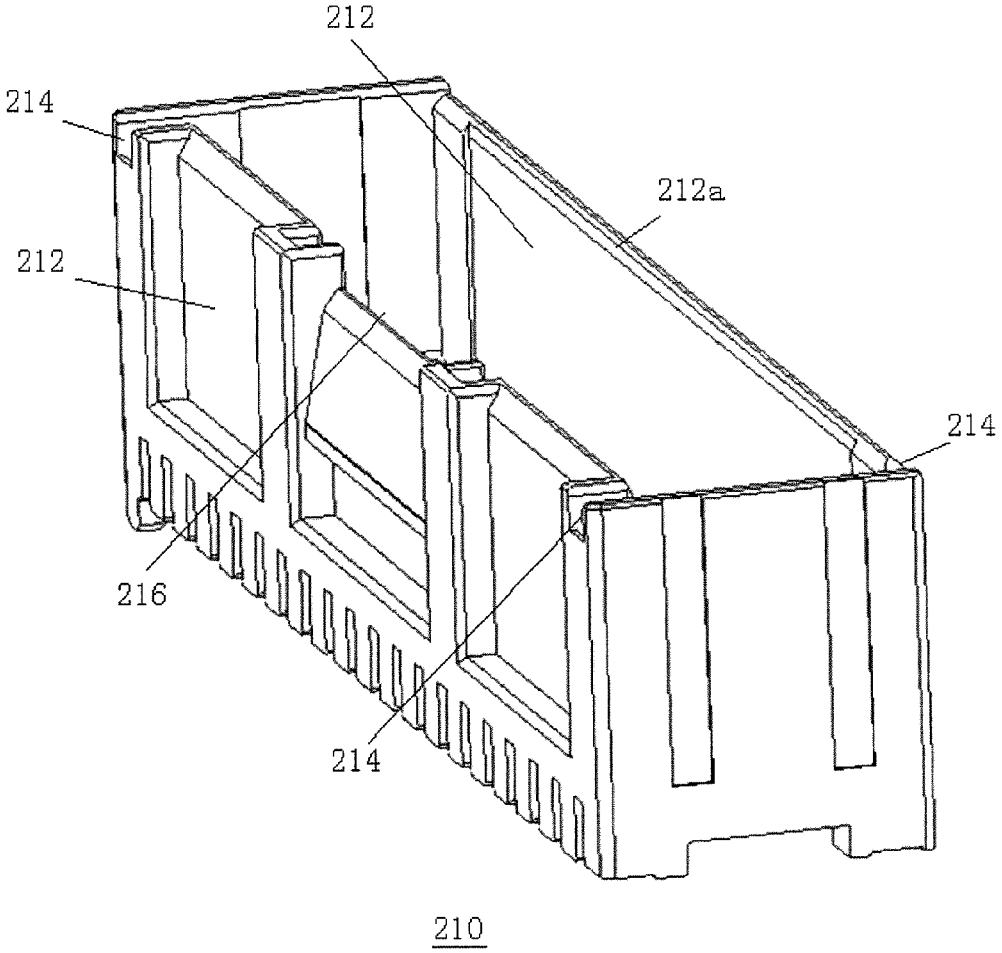
FIG. 3 is a perspective view of a receptacle case according to the present invention.

As shown in FIG. 3, the connector receptacle 200 includes a receptacle case 210 and a plurality of receptacle contacts 220. The receptacle case includes two side walls 212, a plurality of recesses 214, and a rectangle recess 216.

The plurality of receptacle contacts 220 are provided in the receptacle case 210, as shown in FIGS. 4-7.

As shown in FIG. 3, the two side walls 212 are parallel to a length direction of the receptacle case 210. In an exemplary embodiment, a slope is formed on an upper outer edge 212*a* of each of the side walls 212, so as to form a shape tapered upward.

A plurality of recesses 214 are formed at positions of the side walls 212 of the connector receptacle 200 adjacent to end walls of the connector receptacle 200. In the exemplary embodiment of FIG. 3, the recesses 214 are square shaped, but the recesses 214 may be configured to have various shapes as long as they maintain the same interface with the block notches 114 as described below.

A rectangle recess 216 is formed in an upper portion of one of the side walls 212 of the receptacle case 210. The rectangle recess 216 is optionally positioned in the center of the side wall 212, but may be positioned anywhere along the length of the side wall 212.

The assembly of the connector plug 100 and connector receptacle 200 will now be described with reference to FIGS. 3-7. The plug 100 is adapted to be inserted into the connector receptacle 200, so as to electrically connect the plug contacts and the receptacle contacts 220.

As shown in FIG. 4, the connector plug 100 is separated from and does not contact the receptacle contacts 220 in an orientation of the plug 100 in which the block notch 114 of the end wall 112 is engaged with an upper edge 212*a* of one of the two side walls 212 and the bottom side of the end wall 112 abuts against an upper edge of the other of the two side walls 212. As a result, during incorrect aslant insertion of the plug 100 into the receptacle 200, the block notch 114 of the plug 100 is engaged with the upper edge 212*a* of the side wall of the receptacle 200, so as to effectively prevent the bottom of the plug 100 from pressing and damaging the receptacle contacts 220.

The upward tapered shape of the upper outer edge 212*a* can facilitate the engagement of the upper edge of the side wall 212 with the block notch 114 during incorrect aslant insertion of the plug 100. In another embodiment, if the upper edge 212*a* of the side wall 212 has a thin thickness, the upper edge 212*a* of each of the side walls 212 may be not formed in the upward tapered shape.

During aslant insertion of the plug 100 into the receptacle 200, the recesses 214 provide passages through which the block notches 114 of the plug 100 passes while the plug 100 is rotated downward with respect to the upper edge of one side wall 212 of the receptacle 200, so as to prevent the block notch 114 from being engaged or snapped with the upper edge of the side wall 212.

In another orientation of an incorrect aslant insertion of the plug 100 into the receptacle 200, as shown in FIG. 5, the upper edge of the side wall 212 is engaged with the block notch 114 of the other side of the end wall 112. As shown in FIG. 5, in this orientation, the end wall 112 is near the end wall of the receptacle 200. In this case, it can be clearly seen that the plug 100 does not contact the receptacle contacts 220 in the receptacle 200 because the block notch 114 is engaged with the side wall of the receptacle and the plug 100 cannot be further inserted downward.

In another orientation of an incorrect aslant insertion of the plug 100 into the receptacle 200, as shown in FIG. 6, the upper edge of the side wall 212 at the rectangle recess 216 is engaged with the block notch 114 of the end wall 112. In this orientation, the end wall 112 extends into the rectangle recess 216. As a result, even in a case where the end wall 112 is located away from the end wall of the receptacle 200 and contacts the side wall 212 at a lower height due to the rectangle recess 216, since the lower block notch 114 is located at a lower height than the upper block notch 114, the lower block notch 114 is engaged with the side wall 212 at the rectangle recess 216 so as to effectively prevent the plug 100 from contacting the receptacle contacts 220.

Figure 7:
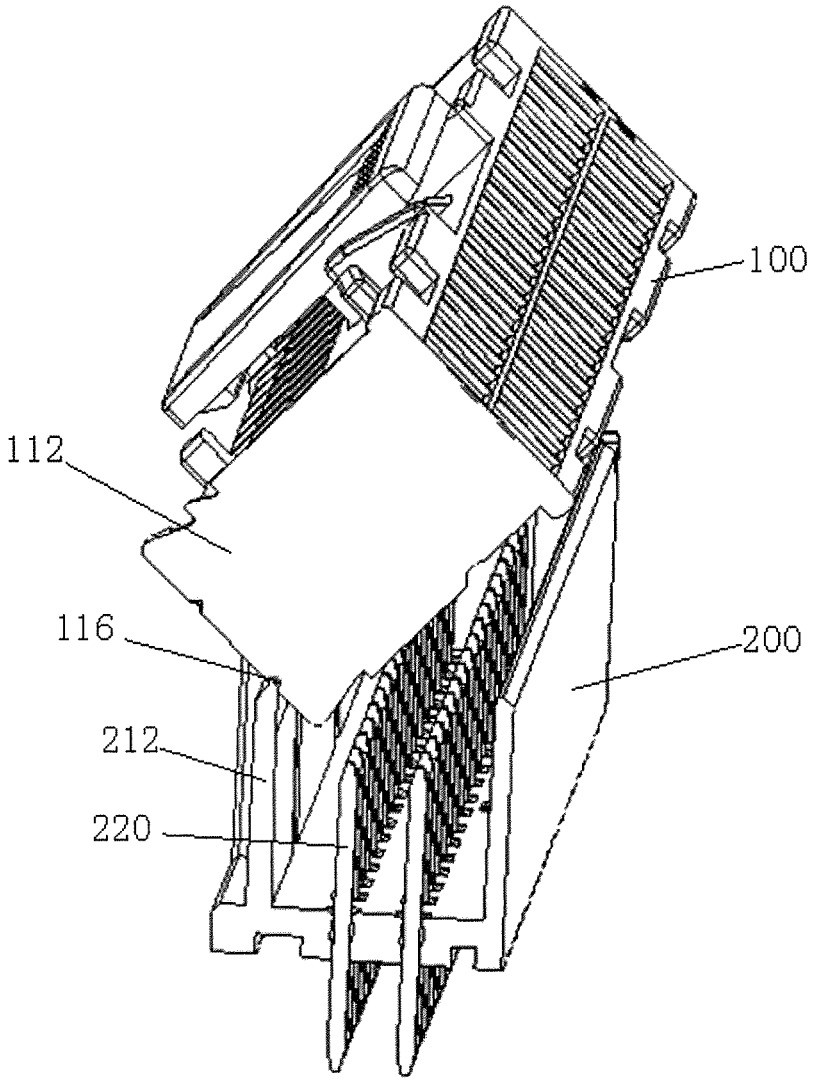
FIG. 7 is a perspective view of the plug of FIG. 2 inserted into the receptacle of FIG. 3 in a fourth orientation.

In another orientation of an incorrect aslant insertion of the plug 100 into the receptacle 200, as shown in FIG. 7, the upper edge of one side wall 212 is engaged with an indentation 116 in a bottom side of the end wall 112, and one side of the end wall 112 may abut against the upper edge of the other side wall. It can be clearly seen that the plug 100 does not contact the receptacle contacts 220 because the indentation 116 is engaged with the side wall 212 and the plug 100 cannot be further inserted downward.

As would be appreciated by one skilled in the art, the embodiments and orientations described above would equally apply if the plug 100 included a plurality of shorter plugs fitting into the one receptacle 200.

What is claimed is:

1. A connector plug, comprising:

a housing; and a plurality of end walls disposed on the housing, the plurality of end walls each including at least one block notch disposed adjacent to a mating end of the housing, each block notch including a guide face extending in a direction aslant and away from a bottom surface of the end wall.

2. The connector plug according to claim 1, further comprising a plurality of plug contacts disposed in the housing.

3. The connector plug according to claim 1, wherein two end walls are disposed at end portions of the housing in a length direction of the housing, the end walls extending orthogonal to the length direction of the housing.

4. The connector plug according to claim 3, wherein the end walls each extend beyond one side of the housing in a width direction of the housing.

5. The connector plug according to claim 4, wherein the end walls extend beyond the same side of the housing.

6. The connector plug according to claim 5, wherein the at least one block notch on each end wall is disposed on the portion of each end wall extending beyond the side of the housing.

7. The connector plug according to claim 3, wherein the end walls each extend beyond both sides of the housing in a width direction of the housing.

8. The connector plug according to claim 7, wherein the block notches are disposed on the portions of each end wall extending beyond the sides of the housing.

9. The connector plug according to claim 8, wherein one block notch is disposed on a first side of each of the end walls, and two block notches separated from each other are disposed on an opposite second side of each of the end walls.

10. The connector plug according to claim 9, wherein the block notch on the first side of each end wall and a block notch on the second side of each end wall are disposed at a same height with respect to a bottom of the end wall.

11. The connector plug according to claim 1, wherein the block notch includes a block face extending away from the end wall in a direction parallel to a width direction of the housing.

12. The connector plug according to claim 1, wherein the plurality of end walls each further include at least one indentation formed in a bottom side of the end wall.

13. A connector assembly, comprising:

a connector receptacle including a receptacle case having two side walls parallel to a length direction of the receptacle case, and a plurality of receptacle contacts disposed in the receptacle case; and a connector plug including a housing, a plurality of end walls disposed on the housing, the plurality of end walls each including at least one block notch disposed adjacent to a mating end of the housing, and a plurality of plug contacts disposed in the housing; wherein the connector plug is mateable with the connector receptacle such that the plug contacts electrically connect with the receptacle contacts, the connector plug separated from the receptacle contacts in a position in which at least one block notch of an end wall is engaged with an upper edge of a side wall.

14. The connector assembly of claim 13, wherein the connector plug is separated from the receptacle contacts in a position in which at least one block notch of an end wall is engaged with an upper edge of a first side wall, and a bottom of the end wall abuts an upper edge of the second side wall.

15. The connector assembly of claim 14, wherein a slope is formed on an upper outer edge of each of the side walls, so as to form a shape tapered upward.

16. The connector assembly of claim 13, wherein the connector plug is separated from the receptacle contacts in a position in which an indentation in a bottom of the end wall is engaged with the upper edge of a first side wall, and a side of the end wall abuts the upper edge of the second side wall.

17. The connector assembly of claim 13, further comprising a rectangle recess disposed in an upper portion of one of the side walls adjacent to the upper edge of the side wall.

18. The connector assembly of claim 17, wherein a side of an end wall includes an upper block notch and a lower block notch, and the lower block notch engages with the upper edge of the side wall adjacent to the rectangle recess.

19. The connector assembly of claim 13, further comprising a plurality of recesses disposed on the side walls and corresponding to the plurality of block notches.

20. The connector assembly of claim 19, wherein in a position in which the connector plug connects with the receptacle contacts, the block notches are disposed within the recesses.

21. A connector assembly, comprising:

a connector receptacle including a receptacle case having two side walls parallel to a length direction of the receptacle case, and a plurality of receptacle contacts disposed in the receptacle case; and a connector plug including a housing, a plurality of end walls disposed on the housing, the plurality of end walls each including at least one block notch disposed adjacent to a mating end of the housing, and a plurality of plug contacts disposed in the housing; wherein the connector plug is mateable with the connector receptacle such that the plug contacts electrically connect with the receptacle contacts, the connector plug separated from the receptacle contacts in a position in which an indentation in a bottom of the end wall is engaged with an upper edge of a first side wall and a side of the end wall abuts an upper edge of the second side wall.

22. A connector assembly, comprising:

a connector receptacle including a receptacle case having two side walls parallel to a length direction of the receptacle case, a plurality of recesses disposed on the side walls, and a plurality of receptacle contacts disposed in the receptacle case; and a connector plug including a housing, a plurality of end walls disposed on the housing, the plurality of end walls each including at least one block notch disposed adjacent to a mating end of the housing, the plurality of block notches corresponding to the plurality of recesses, and a plurality of plug contacts disposed in the housing; wherein the connector plug is mateable with the connector receptacle such that the plug contacts electrically connect with the receptacle contacts.

23. The connector assembly of claim 22, wherein in a position in which the connector plug connects with the receptacle contacts, the block notches are disposed within the recesses.

* * * * *